US005402000A

United States Patent [19]

Owens, II

[11] Patent Number: 5,402,000

[45] Date of Patent: Mar. 28, 1995

[54] SECURITY SYSTEM

[76] Inventor: Joe B. Owens, II, 1527 Planters Ridge La., Alpharetta, Ga. 30201

[21] Appl. No.: 206,459

[22] Filed: Mar. 4, 1994

[51] Int. Cl.[6] ..... G08B 13/08

[52] U.S. Cl. ..... 340/545; 340/426; 340/691

[58] Field of Search ..... 340/691, 545, 426

[56] References Cited

U.S. PATENT DOCUMENTS

| | | | |
|---|---|---|---|
| 4,278,968 | 7/1981 | Arnett et al. | 340/545 |
| 4,867,076 | 9/1989 | Marcone | 109/20 |
| 4,903,863 | 2/1990 | Fink | 222/61 |
| 4,996,521 | 2/1991 | Hollow | 340/691 |
| 5,034,730 | 7/1991 | Lin | 340/691 |
| 5,182,541 | 1/1993 | Bajorek et al. | 340/691 |
| 5,311,166 | 5/1994 | Frye | 340/691 |
| 5,349,335 | 9/1994 | Lin | 340/691 |

FOREIGN PATENT DOCUMENTS

| | | |
|---|---|---|
| 933555 | 8/1963 | United Kingdom . |
| 2000347 | 1/1979 | United Kingdom . |

*Primary Examiner*—Glen Swann III
*Attorney, Agent, or Firm*—James A. Hinkle

[57] ABSTRACT

A room security system has a deterrent sprayer positioned on a ceiling of a room selectively inward and in front of an entryway to the room. A spray nozzle of the deterrent sprayer is directed at nose height of an average or anticipated person and adjustable to diverge conically to about three-to-six feet in diameter at a point of contact with the person after partial entry through the entryway. A position slightly on an open side of the entryway can be selected on a ceiling for an entryway with a closure that opens on side hinges like a conventional door. A position directly in front of the entryway can be selected for an entryway with a closure that slides vertically or horizontally like some windows and doors. A trip of the deterrent sprayer and/or other security devices can be actuated and an actuation signal transmitted by mechanical, electrical, electronic, light, magnetic or gaseous means in working relationship with the closure and the entryway. Tear gas, mace, cayenne pepper and/or other disabling substance can be dischargeable. In addition, identifiers such as scent and coloring can be emitted from nozzles of separate deterrent containers. Further in addition, audio signals such as a siren, various types of light beams, photography, communication directly to the intruder and communication to remote locations such as 911 can be directed from the trip. The trip can be set either manually or remotely by electrical, mechanical, telephonic or other remote-control means.

16 Claims, 3 Drawing Sheets

SECURITY SYSTEM

BACKGROUND OF THE INVENTION

1. Field of the Invention

The present invention relates generally to the field of security systems which detect, deter and identify intruders into buildings and rooms of various structures. In particular, it is related to ceiling-positioning and remote operation of security devices effectively for their activation and operation.

2. Description of the Prior Art

A variety of security devices for deterring, detecting and identifying offenders and intruders are known. None, however, provide a working relationship of a security device to a room and its entryway in a manner and with the effectiveness taught by this invention.

An intrusion-deterrent device which activates a water-spraying system primarily in an outdoor area was described in U.S. Pat. No. 4,996,521 granted to Hollow. While a discouragement to unlawful entry and violence in outdoor areas, it was not a major deterrent which could be employed as a last resort in a bedroom or other room of a stationary or mobile structure. A triggering mechanism for a tear-gas canister was taught by U.S. Pat. No. 4,903,863 granted to Fink. Although effective for activating a deterrent canister, the Fink device did not have a working relationship to a room and its entrance way as taught by this invention. A security device for identifying primarily bank robbers taught positioning of a spray gun in a wall between a bank teller and bank customers to discharge a scent detectable by dogs in U.S. Pat. No. 4,867,076 granted to Marcone. The Marcone patent employed a particular working relationship between scent spray, a room and an activation means. Marcone taught direction of spray from a low position in a room to a low position on an individual. The objective was to deposit scent on waist-down clothing of an individual entering a room or in a room with unauthorized intent. These are examples of prior art that employ different security devices in a different working relationship to a room and an entryway than taught by this invention.

No security device having the working relationship of a room and an entryway taught by this invention is known. None are believed to exist. With all other known devices and their working relationships to a security device, an intruder or burglar is not yet fully subdued or deterred but only slowed down or frightened with uncertain results.

SUMMARY OF THE INVENTION

In accordance with the present invention, it is contemplated that in light of problems that have existed and that are increasing in intensity and violence with social and economic disparities in America, objectives of this invention are to provide a ceiling-mounted security system which:

Aims deterrent spray directly at an intruder's face and upper body from a ceiling of a room inwardly from an entryway where it is most effective and least expected;

Is tripped by unauthorized entry into a room;

Can be turned on remotely for being tripped by unauthorized entry; and

Can be provided with a select variety of deterrent emissions, identifiers, audio signals, lights, photography, and remote communication directly where most effective as a last-resort security system in a room.

This invention accomplishes the above and other objectives with a security device having a deterrent sprayer positioned on a ceiling of a room selectively inward and in front of an entryway to the room. A spray nozzle of the deterrent sprayer is directed at nose height of an average or anticipated person and adjustable to diverge conically to about three-to-six feet in diameter at a point of contact with the person after partial entry through the entryway. A position slightly on an open side of the entryway can be selected on a ceiling for an entryway with a closure that opens on side hinges like a conventional door. A position directly in front of the entryway can be selected for an entryway with a closure that slides vertically or horizontally like some windows and doors. A trip of the security device can be actuated and an actuation signal transmitted to the security device by mechanical, electrical, electronic, light, magnetic or gaseous means in working relationship between the closure of the entryway and the security device. Tear gas, mace, cayenne pepper and/or other disabling substance can be dischargeable from the security device. In addition, identifiers such as scent and coloring can be emitted from nozzles of separate deterrent containers on the security device. Further in addition, audio signals such as a siren, various types of light beams, photography, communication directly to the intruder and communication to remote locations can be directed from the security device. The trip of the security device can be set either manually or remotely by electrical, mechanical, telephonic or other remote-control means.

Other objects, advantages and capabilities of the invention will become apparent from the following description taken in conjunction with the accompanying drawings showing preferred embodiments of the invention.

DESCRIPTION OF THE PREFERRED EMBODIMENTS

Figure 1:
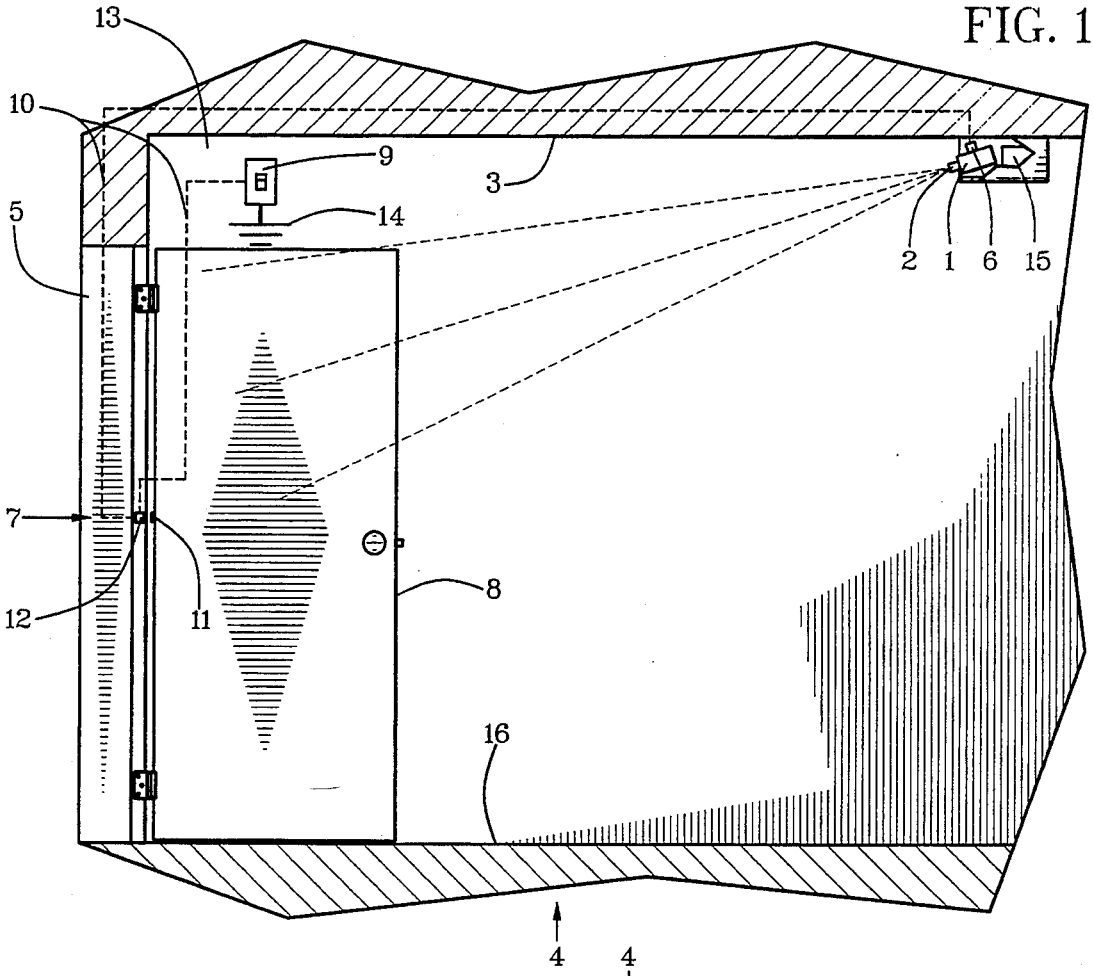
FIG. 1 is a side elevation view at an entryway to a room with a hinged door.

Referring to the drawings wherein like reference numerals designate corresponding parts throughout the several figures, reference is made first to FIG. 1. A deterrent sprayer 1 having a spray nozzle 2 is mounted on a ceiling 3 of a room 4. The spray nozzle 2 is directed at an upper portion of an entryway 5 where spray from the spray nozzle 2 will be in a designed conical spray pattern to contact a top portion of a person entering the room 4 through the entryway 5.

Spray is released by action of a spray-release means 6 on the deterrent sprayer 1 in response to tripping of a sprayer trip 7 that is positioned in closure-trip relationship to a closure such as a hinged door 8 in the entryway 5. The sprayer trip 7 can be designed for manual cocking and uncocking or for remote cocking and uncocking with a remote device such as an electrical switch as a cocking means 9.

An operational relay means 10 in communication between the cocking means 9, the sprayer trip 7 and the spray-release means 6 can be electrical, mechanical or radio-wave means or a select combination of electrical, mechanical and radio-wave means. The operational relay means 10 transmits motion or energy for actuation of components of this security system.

The sprayer trip 7 can be designed for mechanical, electrical or magnetic operation. For magnetic operation, the sprayer trip 7 is operable magnetically by such trip means as positioning a first magnetic member 11 on an inside edge of the hinged door 8 and a second magnetic member 12 on the sprayer trip 7 which is positioned on an edge of the entryway 5. This creates a distance relationship in which the sprayer trip 7 is tripped by travel of the first magnetic member 11 a design distance from the second magnetic member 12 as the hinged door 8 is swivelled arcuately in a direction away from the inside edge of the entryway 5.

The cocking means 9 can be positioned relatively high on a wall 13 in the room 4 or in such other place as will render it unlikely to be confused with other switches and turned on accidently. An electrical source 14 can be provided at cocking means 9 for the entire system or separately for each component of the system in accordance with design preferences.

The deterrent sprayer 1 can be a reloadable type with one or a plurality of discharge volumes. A backup container 15 can be provided for incremental discharge from some types of deterrent sprayers 1 that are designed for containing single discharges. This increases the range of selection of deterrent sprayers. A plurality of discharges is desirable for preventing an intruder from disabling the deterrent sprayer 1 with one quick opening and closing of the door 8 or other closure. It also aids convenience for loading and checking the system when the deterrent sprayer 1 is high enough above a floor 16 to avoid head contact with occupants of the room 4.

Referring to FIG. 12, the deterrent sprayer 1 can be positioned relative to a side of a center of the entryway 5 to provide a spray axis 17 that is not obstructed by partial opening of the hinged door 8. For some use conditions, the spray axis 17 is preferably about 30–45 degrees towards the latch side of the door. This positioning also prevents an intruder from moving to a side to miss the spray axis 17. For most use conditions, straight positioning as shown is preferable.

Figure 3:
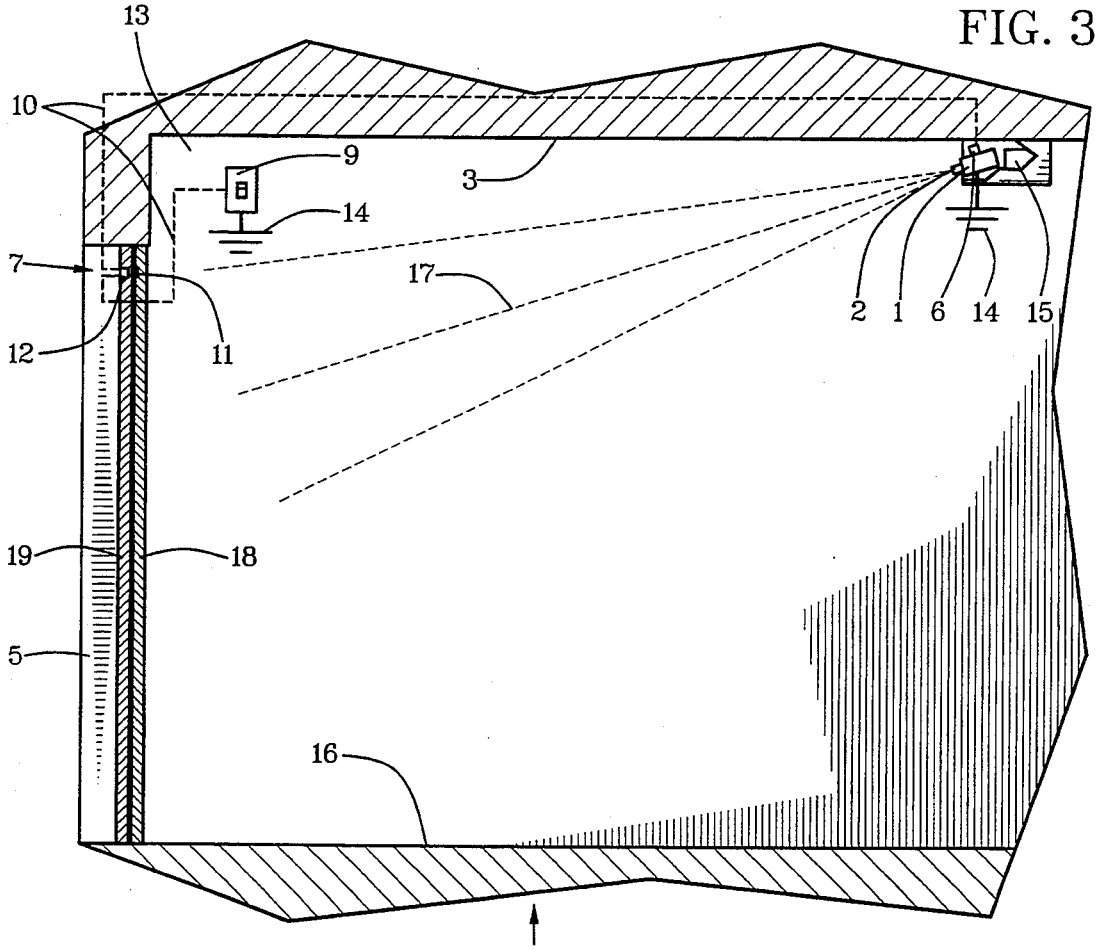
FIG. 3 is a side elevation view at an entryway to a room with a sliding door.

Referring to FIG. 3, the closure of the entryway 5 can be sliding doors with the first magnetic member 11 mounted on a first sliding door 18 and the second magnetic member 12 of the sprayer trip 7 mounted on a second sliding door 19 in juxtaposed relationship as shown. Alternatively, the second magnetic member 12 can be mounted on an edge of the entryway 5 and the first magnetic member 11 can be mounted on an adjacent edge of whichever of only one of the sliding doors 18 or 19 is designed to slide open. In either event, the first magnetic member 11 travels away from the second magnetic member 12.

Figure 2:
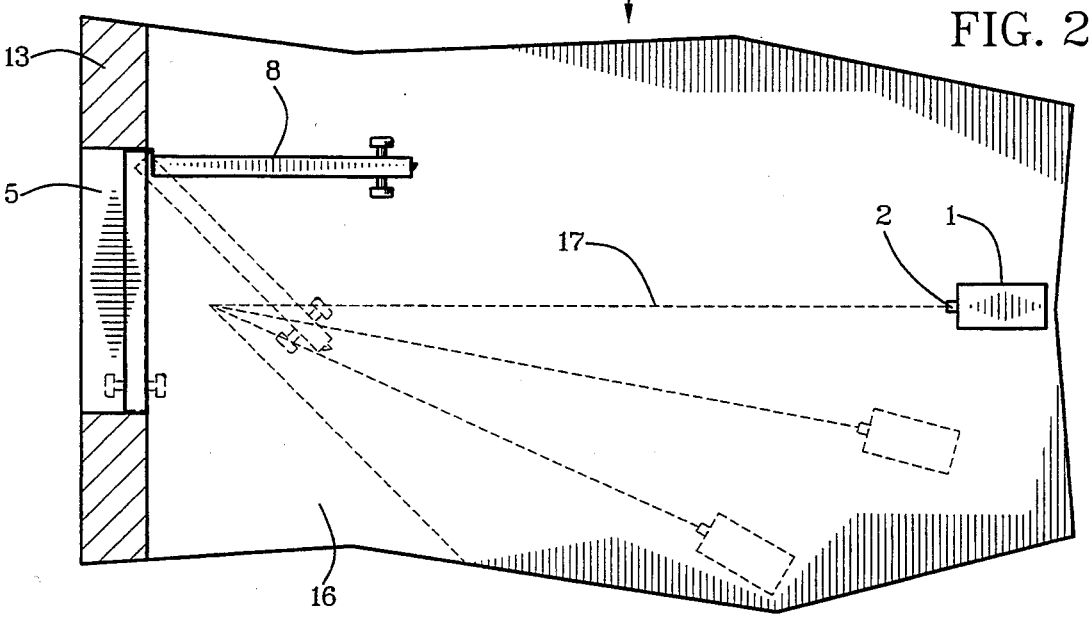
FIG. 2 is a top view at an entryway to a room with a hinged door.
Figure 4:
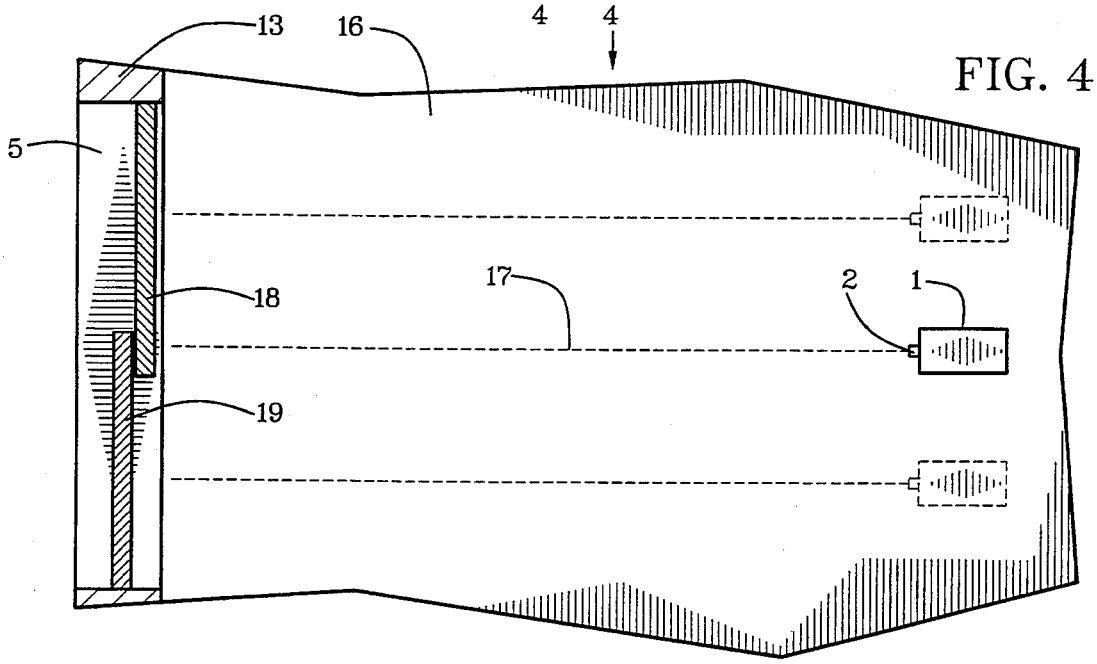
FIG. 4 is a top view at an entryway to a room with a sliding door.

Referring to FIG. 4, the spray axis 17 can be directed towards the top portion of the person anticipated to be entering the room 4 by directing the spray nozzle 12 of the deterrent sprayer 1 perpendicular to the sliding doors 18 and 19 from a position relative to a slide opening of the entryway 5. This perpendicular positioning can be alternatively to or in addition to angular positioning as described in relation to FIG. 2.

Figure 5:
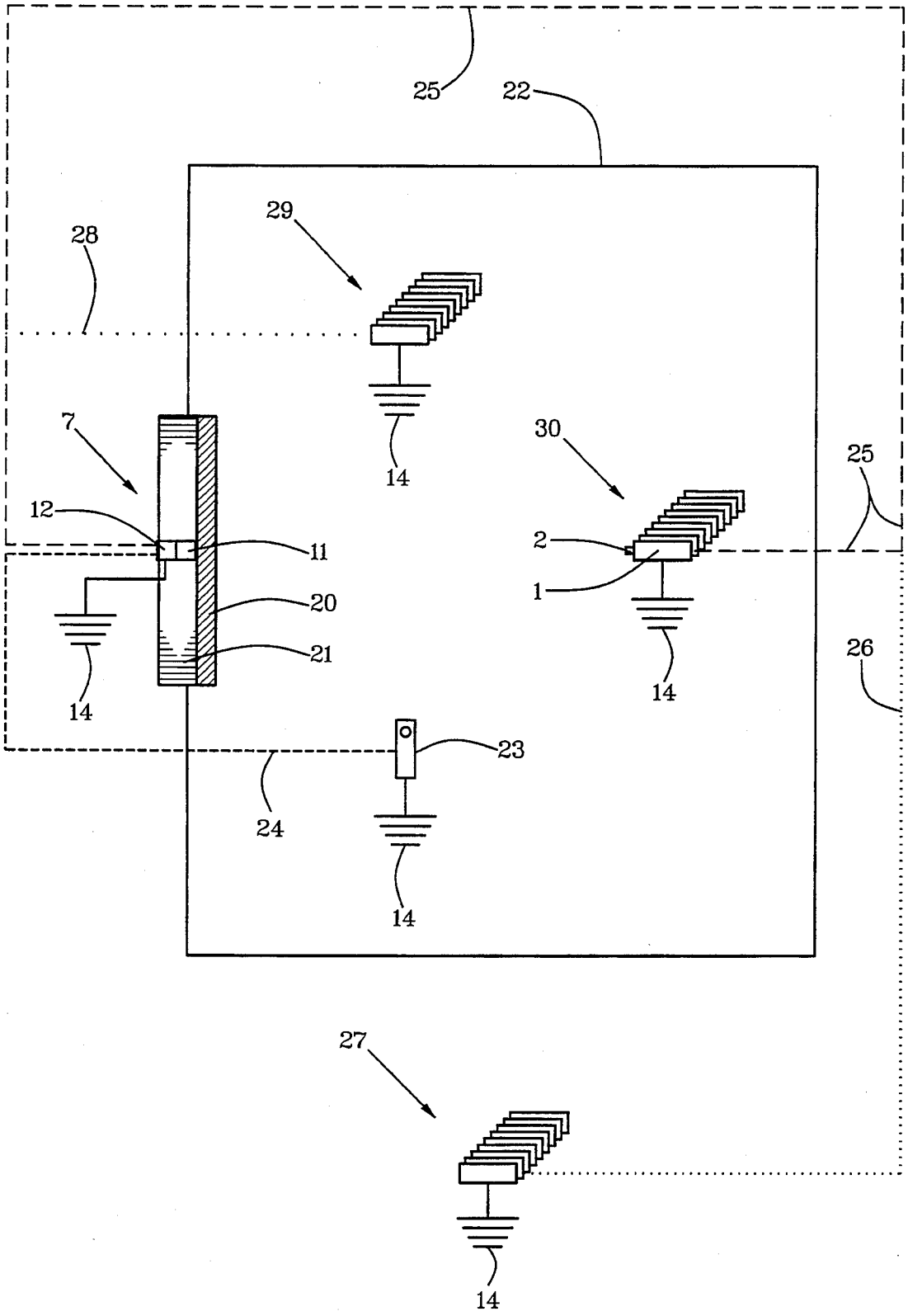
FIG. 5 is a system diagram for a variety of entry ways and for a variety of embodiments.

Reference is made now to FIG. 5 primarily and to FIGS. 1–4 as applicable. For describing the system in relation to any reasonable type of room, foreseeable variations of some components described in relation to FIGS. 1–4 will be referred to as "representative". A representative closure 20 of any type of door or window in any matching type of representative entryway 21 to any type of representative room 22, whether in a real estate structure or in a vehicle, can have the same or a similar deterrent sprayer 1 similarly mounted in relation to an internal periphery of the representative room 22 as described for room 4 in relation to FIGS. 1–4. The same or similar sprayer trip 7 can be operated mechanically, electrically, electronically or as shown with magnetic members 11 and 12 in FIG. 5 as described also in relation to FIGS. 1–4. A representative cocking means 23 can be fixed permanently on a wall as described in relation to FIGS. 1 and 3 or the representative cocking means 23 can be a hand switch that is hand-held to be positioned where, when and as desired in or about the representative room 22 as a last resort for security whenever danger is sensed or known.

The operational relay 10 in FIGS. 1 and 3 is segmented into a plurality of operational relays as follows for description of further embodiments. A cocking relay 24 is in communication between the representative cocking means 23 and the sprayer trip 7. A sprayer relay 25 is in communication between the sprayer trip 7 and the deterrent sprayer 1. A remote relay 26 is in communication between the sprayer relay 25 and remote signals 27. A secondary relay 28 is in communication between the sprayer relay 25 and secondary deterrents 29.

All relays 24, 25, 26, and 28 employ either electrical lines or radio waves for communication of operational control means. The representative cocking means 23 being in communication with the sprayer trip 7, it can be in communication also with the sprayer relay 25 and the remote relay 26 for interactive communication and for direct communication as desired. An electrical source 14 is provided for operational components 23, 1, 27 and 29.

Primary deterrents 30 in addition to or in lieu of deterrent sprayer 1 can include sprayers of mace, tear gas, cayenne pepper or any other legal deterrent. Secondary deterrents 29 can include pop-out objects, flashing lights, audio warnings and audio scaring means. Remote signals 27 can include telephonic calls to 911, scent sprays, paint sprays and flash photography that are designed for remote or subsequent effects.

Various modifications may be made of the invention without departing from the scope thereof and it is desired, therefore, that only such limitations shall be placed thereon as are imposed by the prior art and which are set forth in the appended claims.

What is claimed is:

1. A room security system comprising:

a deterrent sprayer positioned inward from an entryway in a room, a spray nozzle of the deterrent sprayer directed from a top portion of the room towards a top portion of a person anticipated to be entering the room through the entryway, a spray-release means on the deterrent sprayer, a sprayer trip positioned in closure-trip relationship to a closure of the entryway, a cocking means for setting the sprayer trip in either cocked or uncocked mode selectively, and an operational relay means in communication between the cocking means, the sprayer trip and the spray-release.

2. A room security system as claimed in claim 1 wherein the room comprises a plurality of walls, a floor and a ceiling, the spray nozzle is on a deterrent sprayer that is suspended from the ceiling of the room, the closure is a door on hinges attached to a side of the entryway, and the spray nozzle of the deterrent sprayer is directed from a position relative to a side of a center of the entryway to direct spray from the deterrent sprayer onto the top portion of the person anticipated to be entering the room through the entryway when the door is open a select distance such that the door does not obstruct travel of the spray to the top portion of a person anticipated to be entering the room through the entryway after the sprayer trip has been set and tripped.

3. A room security system as claimed in claim 1 wherein the room comprises a plurality of walls, a floor and a ceiling, the spray nozzle is on a deterrent sprayer that is suspended from the ceiling of the room, the closure is a sliding door on a horizontal slide means, and the spray nozzle of the deterrent sprayer is directed from a position relative to a slide opening of the entryway to direct spray from the deterrent sprayer onto the top portion of the person anticipated to be entering the room through the entryway when the door is open a select distance such that the door does not obstruct travel of the spray to the top portion of a person anticipated to be entering the room through the entryway after the sprayer trip has been set and tripped.

4. A room security system as claimed in claim 1 wherein the room comprises a plurality of walls, a floor and a ceiling, the entryway is a window frame, the closure is a window having a window-opening means, the spray nozzle is on a deterrent sprayer that is suspended from the ceiling of the room, and the spray nozzle of the deterrent sprayer is directed from a position relative to the window-opening means to direct spray from the deterrent sprayer onto the top portion of the person anticipated to be entering the room through the window frame when the window is open a select distance such that the window does not obstruct travel of the spray to the top portion of a person anticipated to be entering the room through the window frame after the sprayer trip has been set and tripped.

5. A room security system as claimed in claim 1 wherein the room comprises a plurality of walls, a floor and a ceiling, the entryway is a window frame, the closure is a window having a window-opening means, the spray nozzle is on a deterrent sprayer that is suspended from a wall of the room, and the spray nozzle of the deterrent sprayer is directed from a position relative to the window-opening means to direct spray from the deterrent sprayer onto the top portion of the person anticipated to be entering the room through the window frame when the window is open a select distance such that the window does not obstruct travel of the spray to the top portion of a person anticipated to be entering the room through the window frame after the sprayer trip has been set and tripped.

6. A room security system as claimed in claim 1 wherein the room is in a vehicle, the entryway is a vehicle entryway, the spray nozzle is suspended from a desired surface of the room, and the spray nozzle is directed from a position relative to the vehicle entryway to direct spray from the deterrent sprayer onto the top portion of the person anticipated to be entering the room through the vehicle entryway when the vehicle entryway is open a select distance such that the vehicle entryway does not obstruct travel of the spray to the top portion of a person anticipated to be entering the room through the vehicle entryway after the sprayer trip has been set and tripped.

7. A room security system as claimed in claim 1 wherein the cocking means is an on-site cocking device.

8. A room security system as claimed in claim 1 wherein the cocking means is a remote cocking device.

9. A room security system as claimed in claim 1 wherein the deterrent sprayer has a deterrent container with a volumetric capacity to provide a select plurality of discharges of deterrent, and an incremental-discharge means in communication between the deterrent container and the spray nozzle such that the sprayer can not be disabled by a single opening and closing of the closure.

10. A room security system as claimed in claim I wherein the deterrent sprayer is designed to spray a temporarily disabling substance such as mace, tear gas or cayenne pepper.

11. A room security system as claimed in claim 1 and further comprising at least one audio signaling device, the audio signaling device being positioned where desired for desired effect, and an audio relay in communication between the sprayer trip and the audio signaling device.

12. A room security system as claimed in claim 11 and further comprising at least one visual signaling device, the visual signaling device being positioned where desired for particular effect, and a visual-signal relay in communication between the sprayer trip and the visual signaling device.

13. A room security system as claimed in claim 1 and further comprising at least one of a selection of visual signaling devices such as flashing lights and pop-out objects, the selection of visual signaling devices being positioned where desired for particular effect, and a visual-signal relay in communication between the sprayer trip and the selection of visual signaling devices.

14. A room security system as claimed in claim 1 and further comprising at least one of a selection of trace sprayers of a traceable substance such as traceable scent and coloring material, the selection of trace sprayers being positioned where desired for particular effect, and a trace-sprayer relay in communication between the sprayer trip and the selection of trace sprayers.

15. A room security system as claimed in claim 1 wherein the sprayer trip is operable magnetically by positioning of a first magnetic member on the closure in distance relationship to a second magnetic member on the sprayer trip.

16. A room security system as claimed in claim 1 wherein the cocking means is a remote cocking device that is activated electrically by a switch positioned as desired in and about the room.

* * * * *